US006143454A

United States Patent [19]

Thompson

[11] Patent Number: 6,143,454

[45] Date of Patent: Nov. 7, 2000

[54] COLOR TONER CONTAINING SUBLIMATION DYES FOR USE IN ELECTROPHOTOGRAPHIC IMAGING DEVICES

[75] Inventor: Richard J. Thompson, Ohio Pyle, Pa.

[73] Assignee: International Communications Materials, Inc., Connellsville, Pa.

[21] Appl. No.: 09/071,590

[22] Filed: May 1, 1998

[51] Int. Cl.[7] ..... G03G 9/087; G03G 9/09

[52] U.S. Cl. ..... 430/106; 430/45; 430/111

[58] Field of Search ..... 430/106, 111, 430/45

[56] References Cited

U.S. PATENT DOCUMENTS

| | | | |
|---|---|---|---|
| Re. 31,072 | 11/1982 | Jadwin | 430/99 |
| 4,230,784 | 10/1980 | Nishiguchi et al. | 430/106 |
| 4,246,331 | 1/1981 | Mehl et al. | 430/106 |
| 4,536,462 | 8/1985 | Mehl | 430/106 |
| 5,289,246 | 2/1994 | Menjo | 219/216 |
| 5,366,836 | 11/1994 | Snelling | 430/106 |
| 5,555,813 | 9/1996 | Hale et al. | 101/492 |
| 5,590,600 | 1/1997 | Hale et al. | 101/488 |
| 5,869,167 | 2/1999 | Takeuchi et al. | 430/47 |

*Primary Examiner*—Roland Martin
*Attorney, Agent, or Firm*—Fay, Sharpe, Fagan, Minnich & McKee, LLP

[57] ABSTRACT

The invention relates to a commercially useful color thermal transfer dye sublimation toner comprising at least a binder resin and a sublimation dye component, the binder resin comprising a high molecular weight polymer having a molecular weight of above about 100,000, and the sublimation dye comprising a dye which sublimes at elevated temperatures above about 100° C. The invention further defines a process for the use of the toner.

44 Claims, No Drawings

COLOR TONER CONTAINING SUBLIMATION DYES FOR USE IN ELECTROPHOTOGRAPHIC IMAGING DEVICES

The invention relates to color toner compositions prepared for use in developing electrostatic images by electrophotographic, electrostatic recording and printing processes. More particularly, the invention is directed to sublimation color toner compositions for use in process color, laser jet printers, and copiers.

BACKGROUND OF THE INVENTION

The imaging of textiles and other materials using thermal transfer of sublimable dyes has been commercially practiced for more than 50 years. Creating the images to be transferred has been accomplished using established imaging technologies such as off-set press, silk screen, and ink jet methods, or the like. The image is usually formed on paper using inks containing sublimable dye colorants. The transfer paper decals are then brought into contact with the textile or other material to be decorated and with the application of heat, about 100° to 300° C., and pressure, to assure intimate contact between the donor and receptor, the dye is vaporized and transferred as a gas, imagewise, to the receptor. Thus, a permanent image is formed.

This technology is widely practiced and well understood. With the introduction of laser printers for use with personal computers in the mid 1980's, attempts were made to incorporate thermal transfer sublimable dyes into the toners used in these printers with only limited success. The printers were intended to image in only one color, particularly black. However, when a toner was properly formulated for this application and a sublimable dye was incorporated into the toner, images could be formed which could then be thermally transferred by the application of sufficient heat to vaporize the dye. By this method, a single color image could be formed. Since many of these laser printers used replaceable cartridges to carry the toner to form the image in this electrophotographic process, various of these special thermal transfer toners could be installed in several cartridges, including toners containing the process color dyes for cyan, magenta, and yellow color imaging. Using a color separation program on a personal computer connected to such a laser printer, a skilled operator could effectively create a color separation of a full color image and print each separation by installing in turn the appropriate cartridge containing the indicated color—cyan, magenta, or yellow. By this method, an image containing the appropriate cyan, yellow and magenta thermal transfer dyes can be stepwise constructed. Even a skilled operator, however, would require about 10 minutes to complete the stepwise process to produce one full color image. In addition, due to the multiple passes of a substrate needed to apply all of the colors, and other considerations, registration of the colors is often a problem.

More recently, process color laser printers and copiers have been introduced and have gained some commercial acceptance. However, because the computer technology needed to adapt process color to these printers is relatively new, the printers and copiers are still relatively expensive, thus hindering their widespread use to date.

Given a lack full penetration into the available market of the print engines, there has not been much interest in the preparation of after market toners for these machines by independent producers. Therefore, to date there has been little research successfully completed regarding solving the technical problems associated with preparation of suitable color toners. This lack of interest and effort is due not only to the small, fragmented market, but even more so to the difficult technical challenge that must be addressed by one in this area, i.e., one must solve not only the problems of making a single color toner, but also the problem of making all four color toners which will function well individually while establishing and maintaining a proper color balance between the various color toners during use.

In short, early on there was no need to develop toners for full process color as there were no machines available which provided a means for printing images by this process. More recently, while the machines have become available, there is not a sufficiently large base of them installed to provide an economic incentive to the independent developer to become skilled in formulating toners for full color processing on these machines.

In order to formulate process color thermal transfer dye sublimation toner for use in one or more of the commercial color laser printers or copiers, one must achieve the following: first, one must master an understanding of the process, chemistry and requirements for functional toners for use in the aforementioned machines. Second, one must use this knowledge to develop a functional set of color balanced toners containing sublimable dyes. This necessarily requires an understanding and knowledge of the different chemistry involved in the use of sublimable dyes. Thirdly, the primary images formed using the above-mentioned toners must be suitable for making secondary images on a suitable receptor substrate using conventional dye sublimation thermal transfer methods, i.e., only the dye must transfer, and the toner must stay on the transfer sheet.

A thorough study of the existing color toner technology reveals that the majority of color toner systems in use today are formulated with low melt viscosity, mostly linear polyester resins. It has been found that toners formulated to meet the imaging requirements of the standard toners, as used in the popular commercially successful color laser printers and copiers, which generally employ such low viscosity, often polyester, polymers, are too tacky and sticky for use in making dye sublimation transfer sheets used at the elevated temperatures needed to cause vaporization of the dyes.

Given the foregoing, it becomes clear, as stated above, that there are three basic problems confronting the skilled artisan attempting to formulate a commercially useful set of process color thermal transfer dyes sublimation toners. To reiterate these concerns, first, one must have a knowledge of practical toner formulating, an understanding of color electrophotography and an understanding of color toner technology. Second, one must successfully incorporate thermal transfer sublimation dyes into a totally functional set of toners for use in a commercial color laser printer or copier. And third, one must formulate the toners to function as dye sublimation thermal transfer decals without mass transfer of the toner resin to the secondary substrate.

The most difficult problem is that relating to transferring only the dye to the secondary substrate. For nearly two decades toners have been formulated to retard their inherent tendency to adhere to hot surfaces. At least three approaches to solving this problem are in use in conventional toners today. As taught by U.S. Pat. No. Re 31,072 to Jadwin, high molecular weight and especially cross linked polymers may be used. Another means of solving this problem involves the incorporation of internal lubricating agents, such as waxes. A third solution is the incorporation of inert, preferably organic fillers, such as metal oxides, carbonates and the like, to act as flatting agents and which retard tack in most resins.

The incorporation of two or more of these approaches is especially effective in preventing mass transfer of the toner to the receptor substrate during sublimation transfer of the dye image. The use of inert fillers is particularly well suited to monochrome sublimation toners which have been monocomponent magnetic toners. These toners, which are formulated for use in certain machines, must contain from 25% to 60% by weight magnetite or other suitable magnetic material or pigment in order to properly function in the machine. They typically also contain moderately high molecular weight or even cross linked polymers, and also from about 2% to about 6% of a wax component. While these toners may inadvertently solve the mass transfer problem mentioned above, they do not lend themselves to use in process color printing because of their inherent dark color, which results from the necessary inclusion of magnetic pigments, which are dark colored materials. This coloring affect of the magnetic pigments also detracts from the high degree of transparency which is desirable for a proper blending of the primary colors to produce the various secondary colors. Thus, the incorporation of inert filler materials, most of which are dark colored or opaque, is not suited to full color process imaging.

Attempts at the inclusion of sublimable dyes into toners are seen for example, in U.S. Pat. Nos. 5,555,813 and 4,536,462. U.S. Pat. No. 5,555,813 describes a toner containing a sublimable dye intended for use in the preparation of images to be transferred to a secondary substrate. This patent teaches, however, that in order to transfer the sublimable dye component a molecular sieve, preferably a zeolite, must be included in the toner composition to assist in dye transfer. The molecular sieve retains the dye in its voids and then transfers the dye upon heating at elevated temperatures. U.S. Pat. No. 4,536,462 also discusses the use of sublimation dyes to prepare toner compositions. The toner is a monochrome, magnetic toner product. This teaching requires the inclusion of a surfactant in the composition in order to achieve good image development. As these patents demonstrate, the inclusion of sublimation dyes into toners for color processing requires special considerations.

Transfer sheet printing may be enhanced by the use of sublimation dye colorants. The resins historically used in the process printing and copying industry, however, are not suitable for use when the dye component to be transferred by the process is a sublimation dye. These dyes require the application of high temperatures in order to sublime. The linear polymer resins normally included in toner products, to assure proper colorant dispersion and image quality, and which are well suited for today's most popular printers and copiers, become very tacky and sticky at the elevated temperatures required to sublime the disperse dyes, making clean transfer of the dye alone impossible.

It has remained for this invention to provide toners which meet the above mentioned requirements of excellent functionality as electroscopic toners in various commercial color laser printers and copiers, which contain a balanced set of sublimable dyes, and which resist mass transfer of the toner resin system to the receptor substrate during dye sublimation transfer.

SUMMARY OF THE INVENTION

The invention relates to a means whereby full process color imaging may be accomplished using sublimation dyes which require transfer at elevated temperatures. Further, the invention takes form in a transfer sheet product which transfers only the dye component of a toner containing a sublimable dye to produce full color imaging on all of the print engines commonly in use.

DETAILED DESCRIPTION OF THE INVENTION

The subject invention is related to color toner compositions suitable for use in developing electrostatic images by electrophotographic, electrostatic recording and printing processes. More particularly, the invention is directed to sublimation color toner compositions for use in process color, laser printers and copiers, and to the use of these toners to produce process images suitable for transfer to secondary substrates, wherein only the dye component of the toned image is transferred. The invention takes form in a color toner formulation which is compatible with all types of process color printers and copiers, including laser jet devices, and which does not experience the potential problem of off-set.

The toner product has particular application to the field of transfer images. For example, the toner described hereinafter is particularly well suited to the production of images on a primary substrate, usually a paper-type material, which is then used in a further imaging process, at elevated temperature, whereby the image is transferred from the primary substrate onto a secondary substrate. The secondary substrate may be made of any material. For instance, the image may be transferred to a t-shirt or other item comprised of a fabric-type material or other textile, such as a tote bag, golf towel, ball hat, scarf etc. Further, the images printed on the primary substrate may be applied to ceramic or other substrates, which may take the form of coffee mugs, wall plaques, desk top items, and any number of other items which are generally used to carry transfer decals. Also, the images may be prepared for transfer as removable tattoos.

The color toner product contains sublimation dyes, or disperse dyes, as the coloring component. These dyes are contained in the toner and are transferred to the primary substrate, or transfer sheet, along with the toner product. Subsequently, on the application of elevated temperatures to the toned image, the dye component sublimes and is transferred, alone and without the remaining toner components, to the secondary substrate to produce a full color image having exceptional clarity, sharpness, brightness, and other desirable image qualities. Transfer of the dye component alone is important to the "hand" of the transferred image, and also enhances the visual characteristic of the transferred image.

Because it is important that only the dye component transfer to the secondary substrate, it is imperative that the remaining toner components be unaffected by the application of the high temperatures at which disperse dyes sublime. As was stated previously, linear polymer resin components, which are the resins of choice almost exclusively for the color printers and copiers used today, get tacky at higher temperatures and will transfer to the substrate along with the dye component. This is the case with most current transfer sheets, as is evidenced by the fact that most current transfer sheets appear clean after transfer of the printed image to a secondary substrate, i.e., the entire toner compound has been transferred.

As an alternative to this unacceptable linear polymer resin, the toner newly developed and disclosed herein employs a high molecular weight polymer resin. Usually, polymers are classified by those skilled in the art as low, intermediate, and high molecular weight materials. The high molecular weight polymer materials generally have a molecular weight above about 100,000, and preferably above about 300,000. These polymer materials do not melt and become tacky at the temperatures needed to cause sublimation of the disperse dye components, and therefore are not likely to transfer freely to the secondary substrate.

Some examples of known polymer materials generally used in toner compositions and suited as well for use herein due to there high molecular weight include: polyamides, polyolefins, styrene acrylates, styrene methacrylates, styrene butadienes, cross linked styrene polymers, polyesters, cross linked polyester epoxies, polyurethanes, vinyl resins, including homopolymers or copolymers of two or more vinyl monomers; and polymeric esterification products of a dicarboxylic acid and a diol comprising diphenol. Vinyl monomers include styrene, p-chlorostyrene, unsaturated mono-olefins such as ethylene, propylene, buytlene, isobutylene, and the like; saturated mono-olefins such as vinyl acetate, vinyl propionate and vinyl butyrate; vinyl esters such as esters of monocarboxylic acids, including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide, mixtures thereof; and the like. Examples of specific thermoplastic toner resins include styrene butadiene copolymers with a styrene content of from about 70 to about 95 weight percent. Additionally, cross linked resins, including polymers, copolymers, and homopolymers of the aforementioned styrene polymers may be selected.

Of particular interest in the preferred embodiment of the invention are cross-linked high molecular weight polymer resins, particularly cross-linked polyester resins. As was noted above, however, any high molecular weight polymer material compatible with the mechanics and operational parameters of the printer/copier in which the toner is intended to be used may be employed.

The toner further contains as the colorant a sublimable dye. Such dyes are commonly referred to in the industry as disperse dyes. These dyes generally sublime at a temperature between 120° C. and 220° C., possibly up to 300° C. Typical dyes, classified in the Colour Index under the title "Disperse Dyes", generally chemically belong to groups comprising nitroarylamine, azo and anthraquinone compounds. Generally, they contain an amino group and do not contain a solubilizing sulfonic group.

Suitable dyes include but are not limited to Intratherm Yellow P-1343NT, Intratherm Yellow P-1346NT, Intratherm Yellow P-346, Intratherm Brilliant Yellow P-348, Intratherm Brilliant Orange P-365, Intratherm Brown P-1301, Intratherm Dark Brown P-1303, Intratherm Pink P-1335NT, Intratherm Brilliant Red P-1314NT, Intratherm Red P-1339, Intratherm Blue P-1305NT, Intratherm Blue P-1404, C.I. Disperse Blue 359, Intratherm Orange P-367 Intratherm Brilliant Blue P-1309, C.I. Disperse Red 60, Intratherm Yellow P-343NT, C.I. Disperse Yellow 54, Disperse Blue 60, C.I. Disperse Yellow 82, C.I. Disperse Yellow 54, C.I. Disperse Yellow 3, C.I. Disperse Yellow 23, C.I. Disperse Orange 3, C.I. Disperse Orange 25, C.I. Disperse Orange 7, C.I. Disperse Orange 1, C.I. Disperse Red 1, C.I. Disperse Red 60, C.I. Disperse Red 13, C.I. Disperse Violet 1, C.I. Disperse Blue 14, C.I. Disperse Blue 3, C.I. Disperse Blue 359, C.I. Disperse Blue 19, C.I. Disperse Blue 134, C.I. Disperse Blue 72, C.I. Disperse Blue 26, C.I. Disperse Blue 180, and other suitable dye materials. Such materials are available commercially from Keystone Aniline Corporation, Crompton & Knowles, BASF, Bayer, E. I. du Pont de Nemours & Co., Ciba, ICI, and others. In the foregoing, it is important only that the dye chosen be thermally and chemically stable, be compatible with the polymers in the toner particles and with any other toner additives, and be colorfast.

The toner containing the foregoing binder polymer and disperse or sublimation dye will likely further include such additives as charge control agents, flowability improvers, and other known additives, all particular to the machine or engine in which the toner will be used.

The toner may also contain a wax component to aid the anti-stick properties of the toner. Various natural and synthetic waxes may be used, such as carnauba wax, and polyethylene and polypropylene, and other natural and synthetic wax or wax-like materials available commercially from a number of suppliers. For example, in the preferred embodiment of the toner product an amide wax component is used, particularly an ethylene bis(stearamide). This component need not always be used, however, depending on the other parameters of the toner and the print engine.

The toner may further contain as additives to aid in retarding tack filler material. This material is preferably an inorganic material such as various metal oxides or carbonates or equivalent materials which will perform in the same manner. For example, silicon dioxide, titanium dioxide, aluminum oxide, calcium carbonate, barium sulfate, cerium oxide, iron oxide, strontium titanate, and other such materials may be used.

Charge control agents are added to a toner for the purpose of making the toner product either more electronegative or more electropositive. Whether the toner needs to be made more electronegative or more electropositive is determined by several factors. Some of these include the electronegativity of the remaining toner components as combined, i.e., different colorants and resins may impart different charge characteristics to the toner composition. Also, the carrier, if one will be used, must be considered, as many carrier materials impart a charge to the toner composition. Further, the machine in which the toner is used may impart some charge to the toner, as will the operation thereof. The purpose of the charge control agent component of the toner is to stabilize the toner with respect to electrical charge and thus avoid problems of print quality, color balance, and fogging, which are associated with too much or too little charge on the toner particles.

Charge control agents are generally metal-containing complexes or nitrogen containing compounds, and impart a desired charge to the toner, which either counteracts the charge imparted by other toner components or enhances the same, depending on the components and the agent used. Charge control agents suitable for use in the inventive toner product herein include negative charge control agents such as those commercially available from Orient Chemicals under the trade names S-34, S-37, E-81, E-84, and E-88, those available from Hodagaya Chemical under the trade names TRH, T-77, T-95 and TNS-2, those available commercially from Japan Carlet under the trade name LR-147, and LR-120, those available from Hoechst/Zeneca under the trade designation CCA-7, and other such materials available from BASF and others. Commercially available positive charge control agents, which may also be used, include nigrosine compounds available commercially from Orient Chemicals under the trade designation N-01, N-02, N-03, N-04, N-05, N-06, N-07, N-08, N-09, N-10, N-11, N-12 and N-13, and cetyl pyridinium chloride (CPC) available commercially from several suppliers, and other quaternary ammonium compounds. Also, certain dyes, such as Copy Blue PR sold commercially by Hoechst/Clarient, may be included to contribute a positive charge affect to the toner.

Unlike conventional color toner products, the toner containing a sublimation dye and intended primarily for transfer sheet printing, will ultimately transfer only the dye component of the toner. Therefore, while colorlessness of the charge control agent is imperative for conventional color toners, toner product which is the subject hereof may employ any suitable agent, regardless of the color thereof. As was noted, only the dye will transfer to the secondary substrate so any color in the charge control agent is negligible. Further, the agent may be negative or positive depending on the print engine, the toner components, and the system parameters. The only real limitation in choice of an appropriate agent is that the agent not sublime at the dye sublimation temperature.

Also, the toner may include a post additive agent or agents. These agents are well known in the industry, and vary depending on the print engine for which the toner is being developed. For instance, in the Hewlett Packard print engines, the post additive of choice is actually a combination of additives including titanium dioxide and silica. Similarly, the Canon CLC copiers require the use of a combination of agents, preferably silica and strontium titanate, or silica and titanium dioxide. These post additives and machines are mentioned merely by way of example and are not intended to be the only potentially suited agents or machines or combinations thereof.

The color sublimation toner may be formulated for use in mono component or dual component systems. When the toner will be employed in a dual component system, the toner particles will be further combined with a carrier material. These materials are well known in the industry and are chosen to satisfy the print engine mechanics. Some common carrier materials include ferrite carriers, coated ferrite carriers, steel shot, iron powders, and steel powders, coated and uncoated.

Formulation of Color Sublimation Toner

The toner composition in keeping with this invention may be formulated in the following manner. This formulation processing, however, is intended to be merely exemplary and in no way limits the means of formulating a color toner consistent with the limitations of the appended claims and any equivalents thereof.

Initially, the high molecular weight resin polymer material may be blended with a suitable charge control agent or a combination of charge control agents. In the preferred embodiment of the invention, a cross-linked polyester resin is combined with a zinc salicylic acid charge control complex. Also added to this mixture is the sublimation dye component of choice. At this time, other internal additives may be included. In the preferred embodiment, a wax component is added to aid in the anti-tack characteristic of the toner. This mixture was blended in a Henschel blender. Processing was carried out at elevated temperature, between about 100° C. and 150° C., on a twin screw compounder or equivalent device, and under optimum mixer conditions to produce a molten, homogeneous composition which was then cooled, crushed and ground in a Fluid Energy Mill using compressed air to produce a fine powder of optimum uniform particle size and distribution.

The mean particle size by volume of a toner in keeping with this processing may range from about 5 to 15 microns, as measured on a Coulter Multisizer, depending upon the application and the requirements of the imaging machine in which the toner will be used. Preferably, the Fluid Energy Mill is operated to control not only the mean particle size but also the top side size or largest particles present at about 17 microns. This is accomplished by controlling the air flow and the Classifier Wheel speed of the integral coarse classifier. The resulting fine powder toner is passed through an Air Classifier to selectively remove the ultra-fine particles, usually those of about 5 microns or smaller, which may be detrimental to the electrophotographic process.

The resulting toner powder, produced in accord with the foregoing, will likely exhibit a mean particle size of about 9 microns by volume as measured an a Coulter Multisizer and a distribution ranging from about 5 microns to about 17 microns, with about 75% to 85% of the particles by number being larger than 5 microns and with less than 1% of the particles by volume being larger than 17 microns.

The toner powder thus produced can then be post treated by blending the powder, in a Henschel High Intensity Blender or other suitable blender, with from about 0.4% by weight to about 1.1% by weight of a post additive or a combination of post additives. In the preferred embodiment, a combination of hydrophobic fine silica and hydrophobic fine titanium dioxide is used. Treatment with post additives produces a toner powder with optimum flow properties and charge stability for use in the intended printer/copier machine.

Once the toner has been produced according to the foregoing processing parameters, a printed image may be produced. This image, typically called a transfer sheet in the preferred embodiment of the invention, may then be subjected to any known and conventional thermal transfer technique particularly suited to the secondary substrate for transfer from the transfer substrate to the secondary substrate.

While the preferred embodiment of the invention takes form in a transfer sheet product, it is to be understood that the toner formulation in keeping with this disclosure is equally well suited for use on a variety of print engines as toner for conventional imaging purposes.

What I claim is:

1. A commercially useful process color thermal transfer dye sublimation toner comprising at least a binder resin and a sublimation dye component, said binder resin comprising a high molecular weight cross-linked polymer having a molecular weight of above about 100,000, and said sublimation dye comprising a dye which sublimes at elevated temperatures above about 100° C.

2. The process color thermal transfer dye sublimation toner of claim 1 wherein the binder resin comprises a high molecular weight polyester resin.

3. The process color thermal transfer dye sublimation toner of claim 1 further comprising a wax component selected from the group consisting of synthetic and natural waxes.

4. The process color thermal transfer dye sublimation toner of claim 3 wherein said wax component is selected from the group consisting of carnauba wax, polyethylene wax and polypropylene wax.

5. The process color thermal transfer dye sublimation toner of claim 1 further comprising at least one charge control agent selected from the group consisting of metal-containing complexes and nitrogen-containing compounds, and wherein the charge control agents may be negative or positive, or a combination of negative or positive or negative and positive.

6. The process color thermal transfer dye sublimation toner of claim 1 further comprising a post additive component wherein said post additive component comprises at least one post additive agent selected from the group consisting of titanium oxide, silicon oxide, aluminum oxide, and strontium titanate.

7. A color toner set comprising a cyan toner, a magenta toner, a yellow toner, and a black toner, each said toner comprising at least a binder resin and a sublimation dye component, said binder resin comprising a high molecular weight cross-linked polymer having a molecular weight of above about 100,000, and said sublimation dye comprising a dye which sublimes at elevated temperatures above about 100° C.

8. The color toner set of claim 7 wherein the binder resin comprises a high molecular weight polyester resin.

9. The color toner set of claim 7 further comprising a wax component selected from the group consisting of synthetic and natural waxes.

10. The color toner set of claim 9 wherein said wax component is selected from the group consisting of carnauba wax, polyethylene wax and polypropylene wax.

11. The color toner set of claim 7 further comprising at least one charge control agent selected from the group consisting of metal-containing complexes and nitrogen-containing compounds, and wherein the charge control agents may be negative or positive, or a combination of negative or positive or negative and positive.

12. The color toner set of claim 7 further comprising a post additive component wherein said post additive component comprises at least one post additive agent selected from the group consisting of titanium oxide, silicon oxide, aluminum oxide, and strontium titanate.

13. A commercially useful process color thermal transfer dye sublimation toner comprising at least a binder resin and a magenta sublimation dye component, said binder resin comprising a high molecular weight cross-linked polymer having a molecular weight of above about 100,000, and said sublimation dye comprising a magenta dye which sublimes at elevated temperatures above about 100° C.

14. The process color thermal transfer dye sublimation toner of claim 13 wherein the binder resin comprises a high molecular weight polyester resin.

15. The process color thermal transfer dye sublimation toner of claim 13 further comprising a wax component selected from the group consisting of synthetic and natural waxes.

16. The process color thermal transfer dye sublimation toner of claim 15 wherein said wax component is selected from the group consisting of carnauba wax, polyethylene wax and polypropylene wax.

17. The process color thermal transfer dye sublimation toner of claim 13 further comprising at least one charge control agent selected from the group consisting of metal-containing complexes and nitrogen-containing compounds, and wherein the charge control agents may be negative or positive, or a combination of negative or positive or negative and positive.

18. The process color thermal transfer dye sublimation toner of claim 13 further comprising a post additive component wherein said post additive component comprises at least one post additive agent selected from the group consisting of titanium oxide, silicon oxide, aluminum oxide, and strontium titanate.

19. A commercially useful process color thermal transfer dye sublimation toner comprising at least a binder resin and a cyan sublimation dye component, said binder resin comprising a high molecular weight cross-linked polymer having a molecular weight of above about 100,000, and said sublimation dye comprising a cyan dye which sublimes at elevated temperatures above about 100° C.

20. The process color thermal transfer dye sublimation toner of claim 19 wherein the binder resin comprises a high molecular weight polyester resin.

21. The process color thermal transfer dye sublimation toner of claim 19 further comprising a wax component selected from the group consisting of synthetic and natural waxes.

22. The process color thermal transfer dye sublimation toner of claim 21 wherein said wax component is selected from the group consisting of carnauba wax, polyethylene wax and polypropylene wax.

23. The process color thermal transfer dye sublimation toner of claim 19 further comprising at least one charge control agent selected from the group consisting of metal-containing complexes and nitrogen-containing compounds, and wherein the charge control agents may be negative or positive, or a combination of negative or positive or negative and positive.

24. The process color thermal transfer dye sublimation toner of claim 19 further comprising a post additive component wherein said post additive component comprises at least one post additive agent selected from the group consisting of titanium oxide, silicon oxide, aluminum oxide, and strontium titanate.

25. A commercially useful process color thermal transfer dye sublimation toner comprising at least a binder resin and a combination of sublimation dye components which render a black image, said binder resin comprising a high molecular weight cross-linked polymer having a molecular weight of above about 100,000, and said sublimation dye comprising a combination of dye components which sublimes at elevated temperatures above about 100° C. to produce a black image.

26. The process color thermal transfer dye sublimation toner of claim 25 wherein the binder resin comprises a high molecular weight polyester resin.

27. The process color thermal transfer dye sublimation toner of claim 25 further comprising a wax component selected from the group consisting of synthetic and natural waxes.

28. The process color thermal transfer dye sublimation toner of claim 27 wherein said wax component is selected from the group consisting of carnauba wax, polyethylene wax and polypropylene wax.

29. The process color thermal transfer dye sublimation toner of claim 25 further comprising at least one charge control agent selected from the group consisting of metal-containing complexes and nitrogen-containing compounds, and wherein the charge control agents may be negative or positive, or a combination of negative or positive or negative and positive.

30. The process color thermal transfer dye sublimation toner of claim 25 further comprising a post additive component wherein said post additive component comprises at least one post additive agent selected from the group consisting of titanium oxide, silicon oxide, aluminum oxide, and strontium titanate.

31. A transfer sheet color toner comprising at least a binder resin and a sublimation dye component, said binder resin comprising a high molecular weight cross-linked polymer having a molecular weight of above about 100,000, and said sublimation dye comprising a dye which sublimes at elevated temperatures above about 100° C.

32. The process color thermal transfer dye sublimation toner of claim 31 wherein the binder resin comprises a high molecular weight polyester resin.

33. The process color thermal transfer dye sublimation toner of claim 32 wherein the binder resin comprises a cross-linked high molecular weight polyester resin.

34. The process color thermal transfer dye sublimation toner of claim 31 further comprising a wax component selected from the group consisting of synthetic and natural waxes.

35. The process color thermal transfer dye sublimation toner of claim 34 wherein said wax component is selected from the group consisting of carnauba wax, polyethylene wax and polypropylene wax.

36. The process color thermal transfer dye sublimation toner of claim 31 further comprising at least one charge control agent selected from the group consisting of metal-containing complexes and nitrogen-containing compounds, and wherein the charge control agents may be negative or positive, or a combination of negative or positive or negative and positive.

37. The process color thermal transfer dye sublimation toner of claim 31 further comprising a post additive component wherein said post additive component comprises at least one post additive agent selected from the group consisting of titanium oxide, silicon oxide, aluminum oxide, and strontium titanate.

38. A commercially useful process color thermal transfer dye sublimation toner comprising: a binder resin component comprising at least one polymer which is a high molecular weight cross-linked polymer having a molecular weight of above about 100,000;

a sublimation dye component comprising at least one dye which sublimes at elevated temperatures above about 100° C.;

a wax component;

a polymeric filler component;

a charge control agent component; and a post additive treatment agent component comprising at least one such agent.

39. The process color thermal transfer dye sublimation toner of claim 38 wherein the binder resin comprises a high molecular weight polyester resin.

40. The process color thermal transfer dye sublimation toner of claim 38 wherein the wax component comprises a wax selected from the group consisting of synthetic and natural waxes.

41. The process color thermal transfer dye sublimation toner of claim 40 wherein said wax component is selected from the group consisting of carnauba wax, polyethylene wax and polypropylene wax.

42. The process color thermal transfer dye sublimation toner of claim 38 wherein the charge control agent component comprises at least one charge control agent selected from the group consisting of metal-containing complexes and nitrogen-containing compounds, and wherein the charge control agents may be negative or positive, or a combination of negative or positive or negative and positive.

43. The process color thermal transfer dye sublimation toner of claim 38 wherein said post additive component comprises at least one post additive agent selected from the group consisting of titanium oxide, silicon oxide, aluminum oxide, and strontium titanate.

44. The process color thermal transfer dye sublimation toner of claim 38 wherein said polymeric filler component comprises a material selected from the group consisting of silicon dioxide, titanium dioxide, aluminum oxide, calcium carbonate, barium sulfate, cerium oxide, iron oxide, and strontium titanate.

* * * * *